US007024967B1

(12) United States Patent
Cheng

(10) Patent No.: US 7,024,967 B1
(45) Date of Patent: Apr. 11, 2006

(54) RATCHET WHEEL STRUCTURE

(76) Inventor: Chin Shun Cheng, No. 22, Lane 427, Dasheng Street, Taichung City 408 (TW)

( * ) Notice: Subject to any disclaimer, the term of this patent is extended or adjusted under 35 U.S.C. 154(b) by 0 days.

(21) Appl. No.: 11/156,277

(22) Filed: Jun. 20, 2005

(51) Int. Cl.
*B24B 13/48* (2006.01)

(52) U.S. Cl. ..... 81/60; 81/119; 81/176.1

(58) Field of Classification Search ..... 81/60, 81/119, 121, 176.1, 176.2, 63
See application file for complete search history.

(56) References Cited

U.S. PATENT DOCUMENTS 6,341,543 B1 * 1/2002 Hsieh ..... 81/63.2
6,575,059 B1 * 6/2003 Liu ..... 81/60
6,668,686 B1 * 12/2003 Hsien ..... 81/60

* cited by examiner

*Primary Examiner*—Lee D. Wilson
*Assistant Examiner*—Anthony Ojini

(57) ABSTRACT

A ratchet wheel structure includes a latch edge, a containing groove and a groove coupled in sequence, and the latch edge disposed at an internal periphery of the ratchet wheel is a flange, and the containing groove is disposed between the latch edges, and the groove is protruded from the middle of a protruded surface of the latch edge for dividing the latch edge into two.

3 Claims, 17 Drawing Sheets

RATCHET WHEEL STRUCTURE

BACKGROUND OF THE INVENTION

1. Field of the Invention

The present invention relates a ratchet wheel structure, and more particularly to a ratchet wheel structure applicable for various kinds of screw devices.

2. Description of the Related Art

Referring to FIG. 17 for a prior art ratchet wheel structure, a ratchet wheel 60 is pivotally coupled to a wrench, and the ratchet wheel 60 includes a polygonal groove 61, which is generally in a dodecagonal shape or a hexagonal shape for turning a hexagonal screw device. However, the prior art has the following shortcomings:

If the polygonal groove 61 comes with a different shape, then the wrench can only work for a compatible screw device, and such wrench has a poor expandability.

Further, the wrench disclosed in U.S. Pat. No. 5,295,422 also has a poor expandability.

SUMMARY OF THE INVENTION

Therefore, it is a primary objective of the prevent invention to provide a ratchet wheel structure, comprising a latch edge, a containing groove and a groove arranged in sequence, and the latch edge at the internal periphery of the ratchet wheel is a flange, and the containing groove is disposed between the first and second latch edges, and the groove is protruded from the central position of a protruded surface of the latch edge for dividing the latch edge into two.

DETAILED DESCRIPTION OF THE PREFERRED EMBODIMENTS

Figure 1:
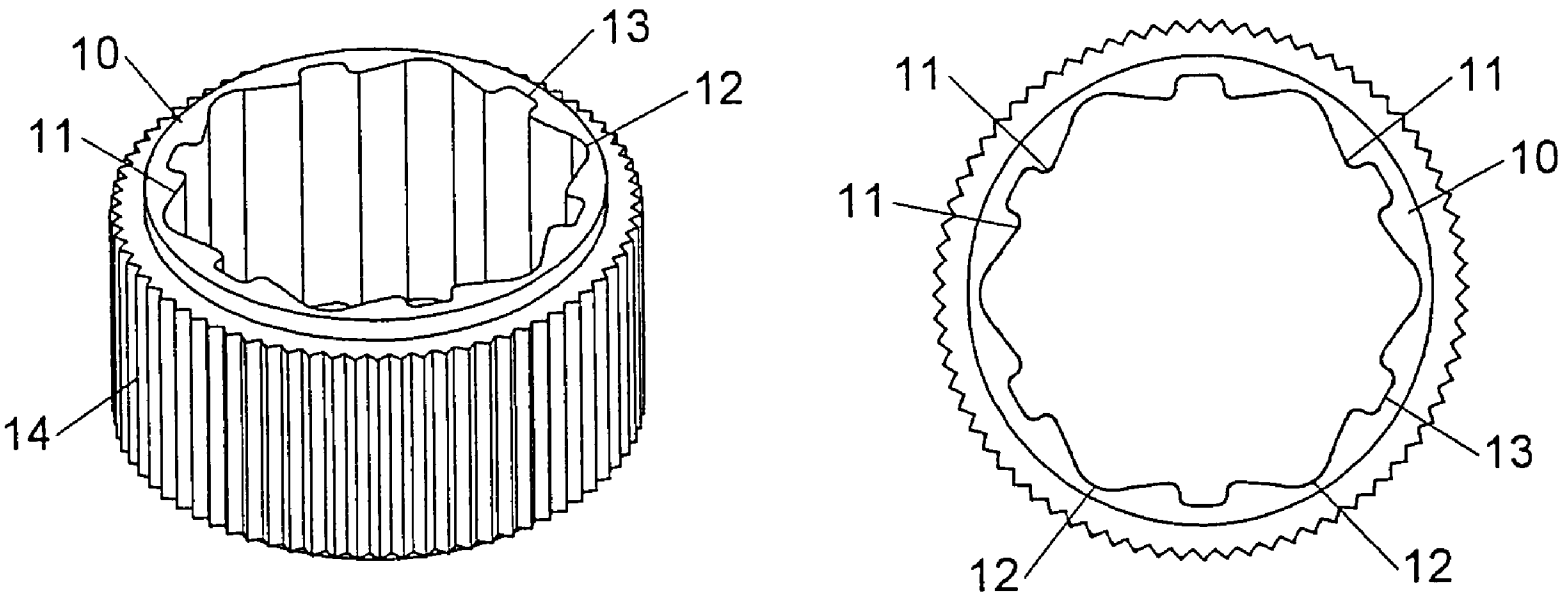
FIG. 1 is a schematic view of a ratchet wheel of the invention.

Referring to FIG. 1, the ratchet wheel structure in accordance with the invention comprises a ratchet wheel 10 including circular serrations 14 at its periphery, a latch edge 11, a containing groove 12 and a groove 13 disposed on the internal circumference at an acting end, The latch edge 11 is a protruded curved surface, and the containing groove 12 is disposed between a first latch edge 11 and a second latch edge 11, and a groove 13 is disposed at the middle of a curved surface of the latch edge 11 for containing a flange 61 of a screw device 40, and the two lateral sides of the groove 13 are parallel, and the bottom is linear, so as to divide the curved surface of the latch edge 11 into two.

Figure 2:
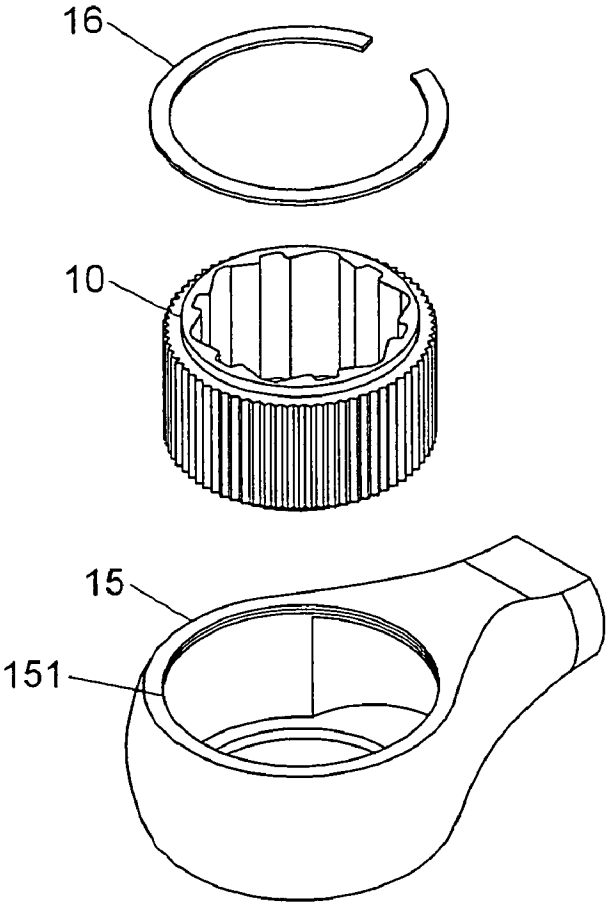
FIG. 2 is a schematic view of a ratchet wheel being installed to a ratchet wheel wrench according to the invention.

Referring to FIG. 2, the ratchet wheel 10 is latched into an accommodating hole 151 of a wrench 15 by a latch 16, such that the ratchet wheel 10 can be turned to rotate the screw device, and the ratchet wheel 10 is pivotally coupled or fixed to the accommodating hole 151 of the wrench 15.

Figure 3:
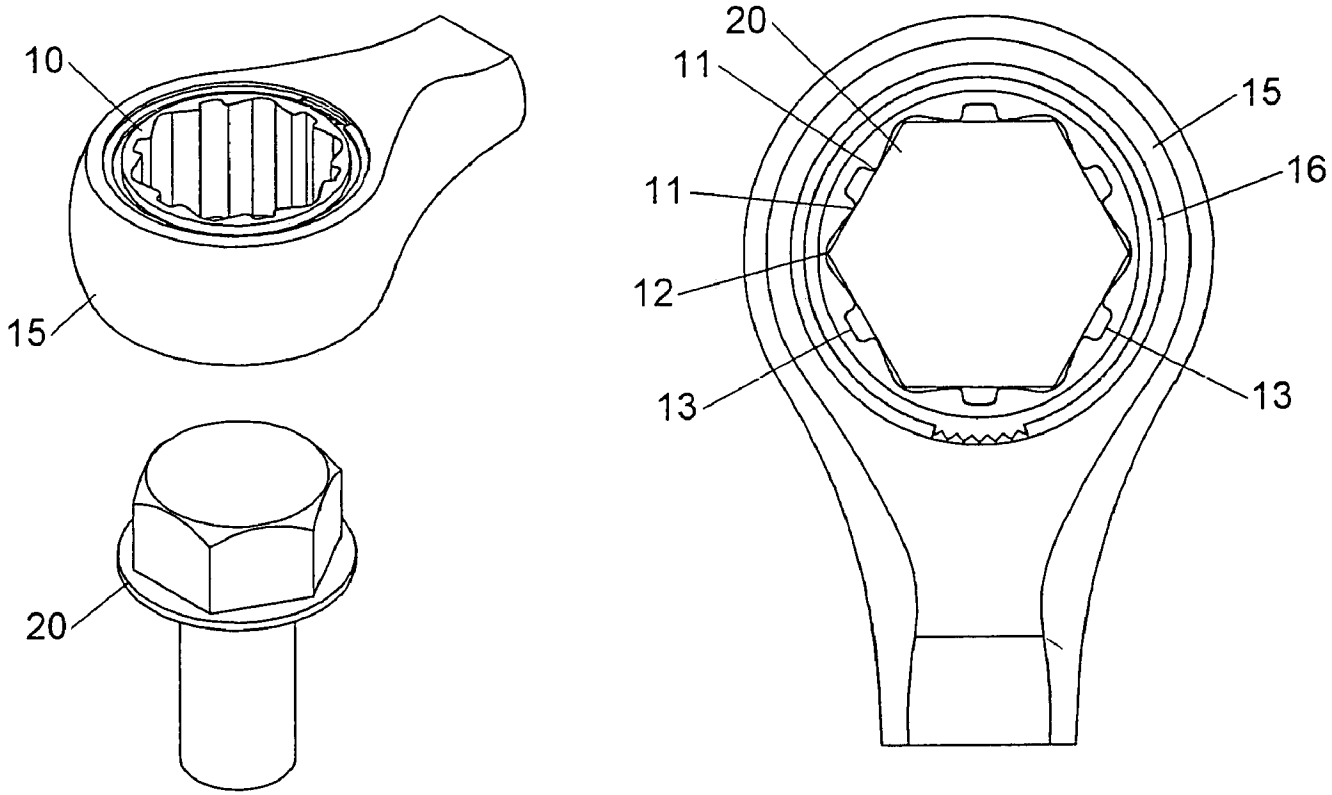
FIG. 3 is a schematic view of turning a hexagonal screw device according to the invention.

Referring to FIG. 3, the ratchet wheel 10 can accommodate a hexagonal screw device 20. Since the ratchet wheel 10 includes a latch edge 11, a containing groove 12 and a groove 13 disposed at the internal circumference, therefore the latch edge 11 can press against the six sides of the hexagonal screw device 20, and the six corners of the hexagonal screw device 20 are accommodated in containing grooves 12 of the ratchet wheel 1, such that the screw device 20 can be turned.

Figure 4:
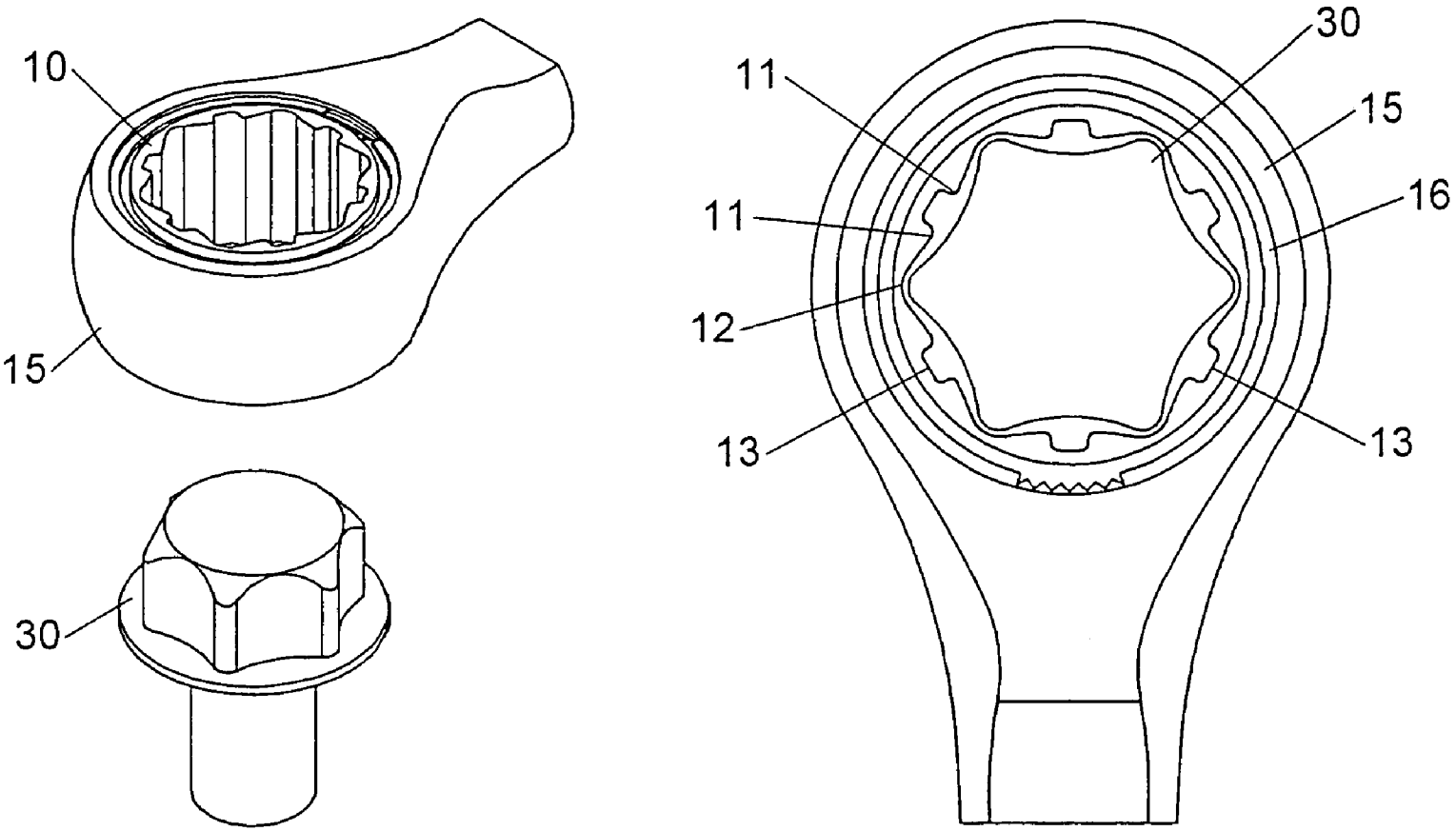
FIG. 4 is a a is a schematic view of turning a star-shape screw device according to the invention.

Referring to FIG. 4, the ratchet wheel 10 engages a star-shape screw device 30, and the containing groove 12 at the six corners of the ratchet wheel 10 can be turned.

Figure 5:
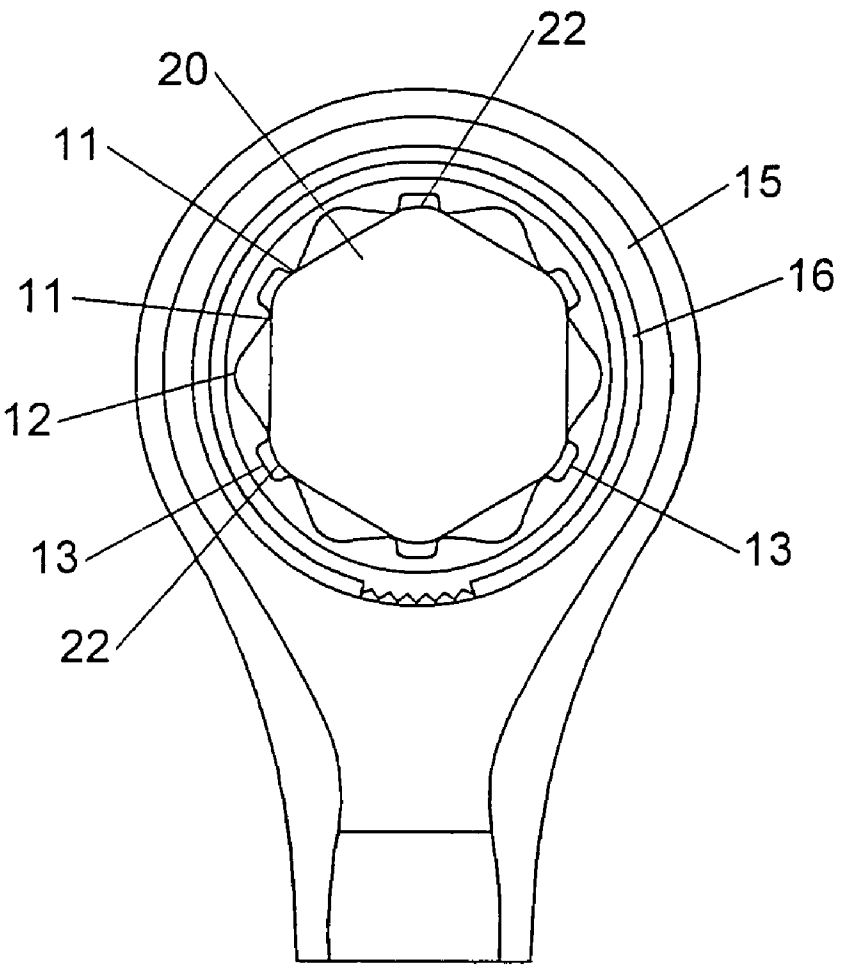
FIG. 5 is a schematic view of turning a round screw device according to the invention.
Figure 5:
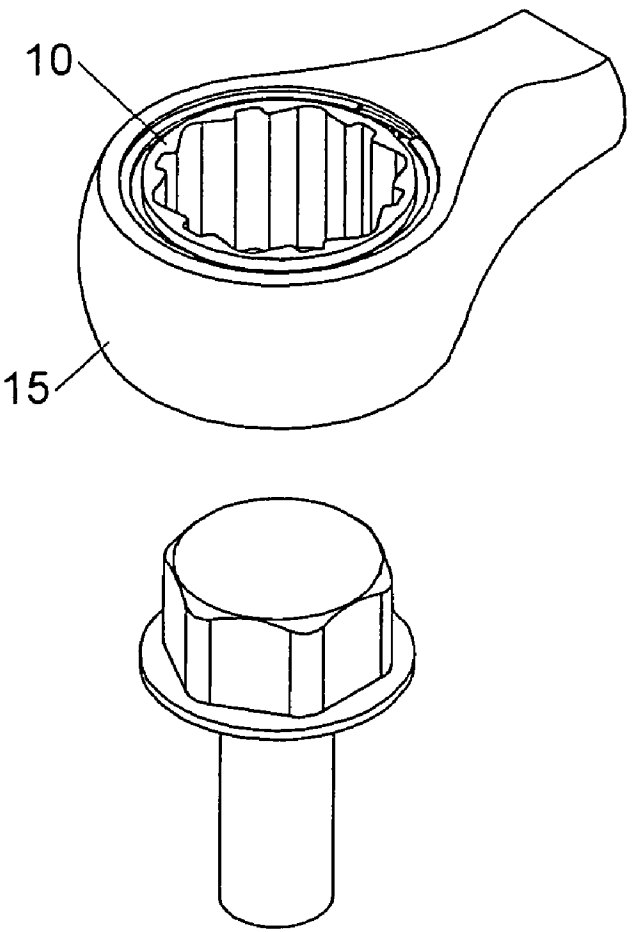

Referring to FIG. 5, the screw device 20 is hexagonal in shape, and the six corners are worn and damaged after a long use. By that time, the grooves 13 of the ratchet wheel 10 are engaged precisely with the round corners to turn the six corners of the screw device 20.

Figure 6:
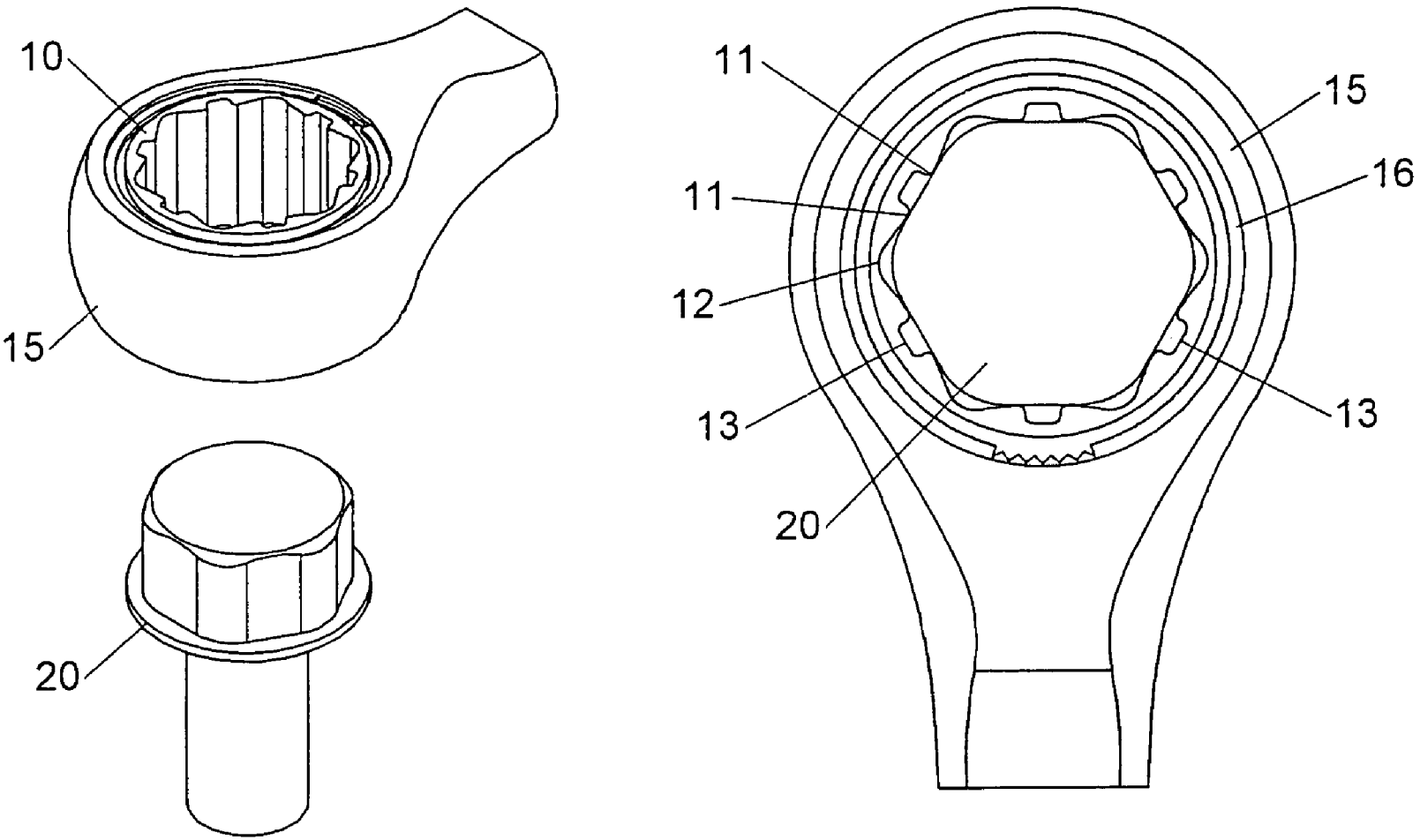
FIG. 6 is another schematic view of turning a round screw device according to the invention.

Referring to FIG. 6, the hexagonal corners of the screw device 20 are worn and changed into round corners 22, which can be engaged into the ratchet wheel 10 to achieve the similar turning effect.

Figure 7:
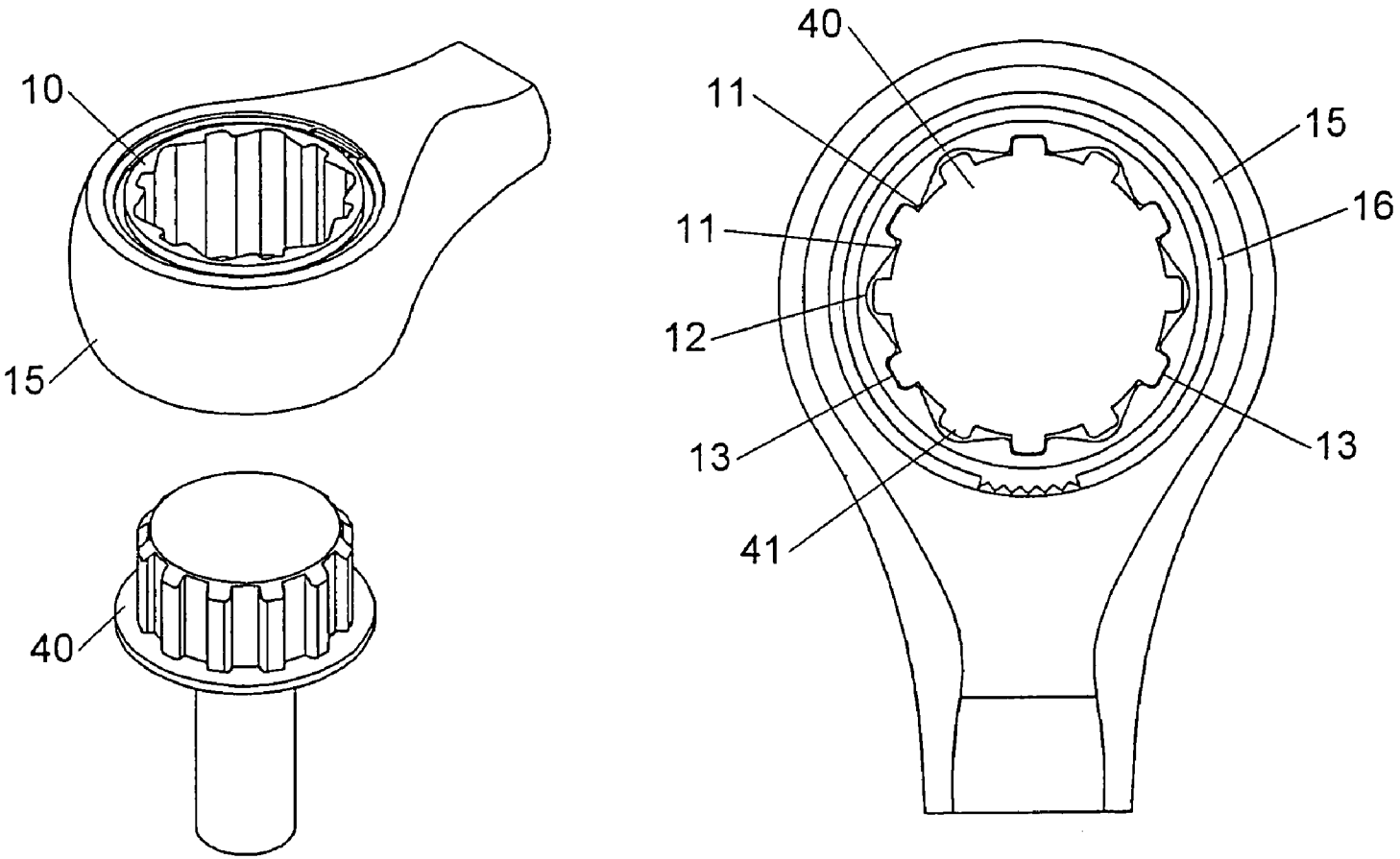
FIG. 7 is a schematic view of turning a gear-shape screw device according to the invention.

Referring to FIG. 7, the ratchet wheel 10 accommodates a gear-shape screw device 40. Since the ratchet wheel 10 includes a latch edge 11, a containing groove 12 and a groove 13, therefore the latch edge 11 can press against the twelve sides of the gear-shape screw device 40. At that time, the six flanges 41 of the gear-shape screw device 40 are accommodated into the containing groove 12 of the ratchet wheel 10, and the other six flanges 41 are latched precisely into the groove 13, such that the gear-shape screw device 40 can be turned.

Figure 8:
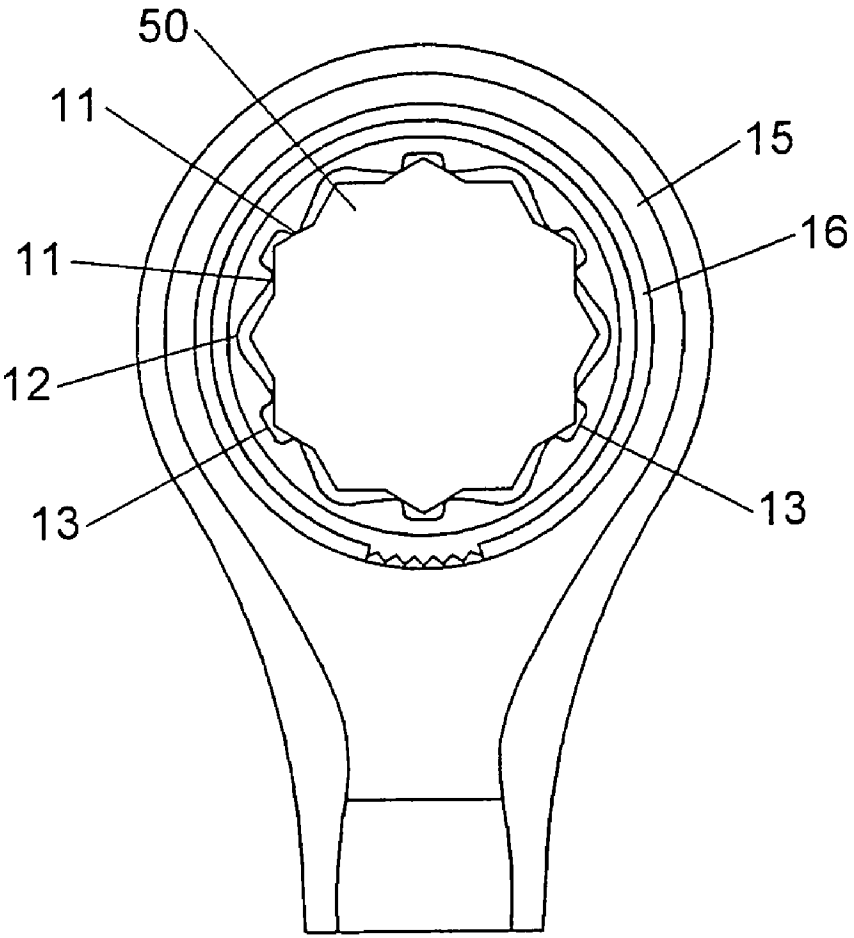
FIG. 8 is a schematic view of turning a dodecagonal screw device according to the invention.
Figure 8:
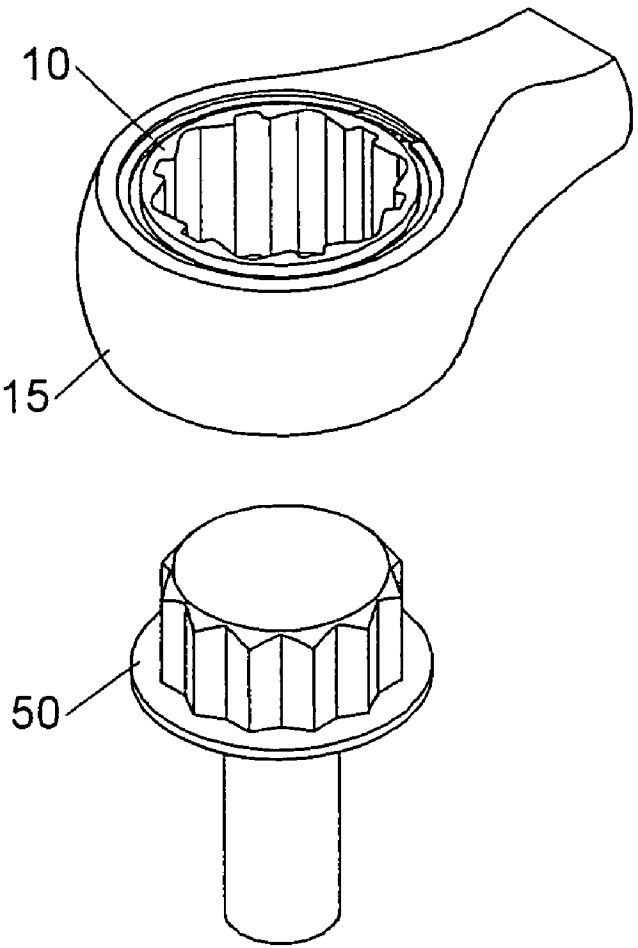

Referring to FIG. 8, the ratchet wheel 10 accommodates a dodecagonal screw device 50, and its operating principle and effect are the same as those illustrated in FIG. 7.

Figure 9:
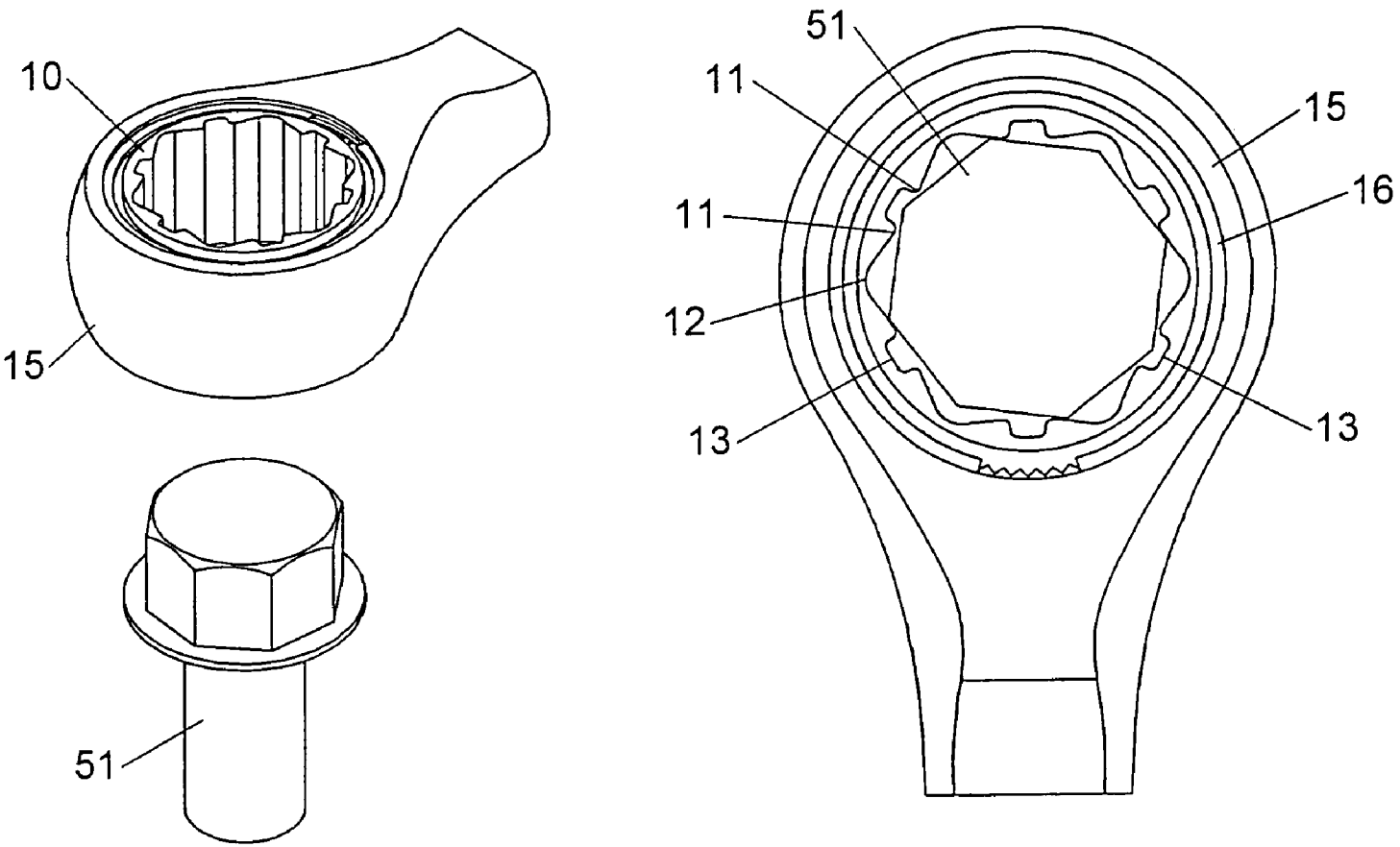
FIG. 9 is a schematic view of turning a octagonal screw device according to the invention.

Referring to FIG. 9, the ratchet wheel 10 accommodates an octagonal screw device 51, and the latch edges 11 of the ratchet wheel 10 can press against the eight sides of the octagonal screw device 51, such that the octagonal screw device 51 can be turned.

Figure 10:
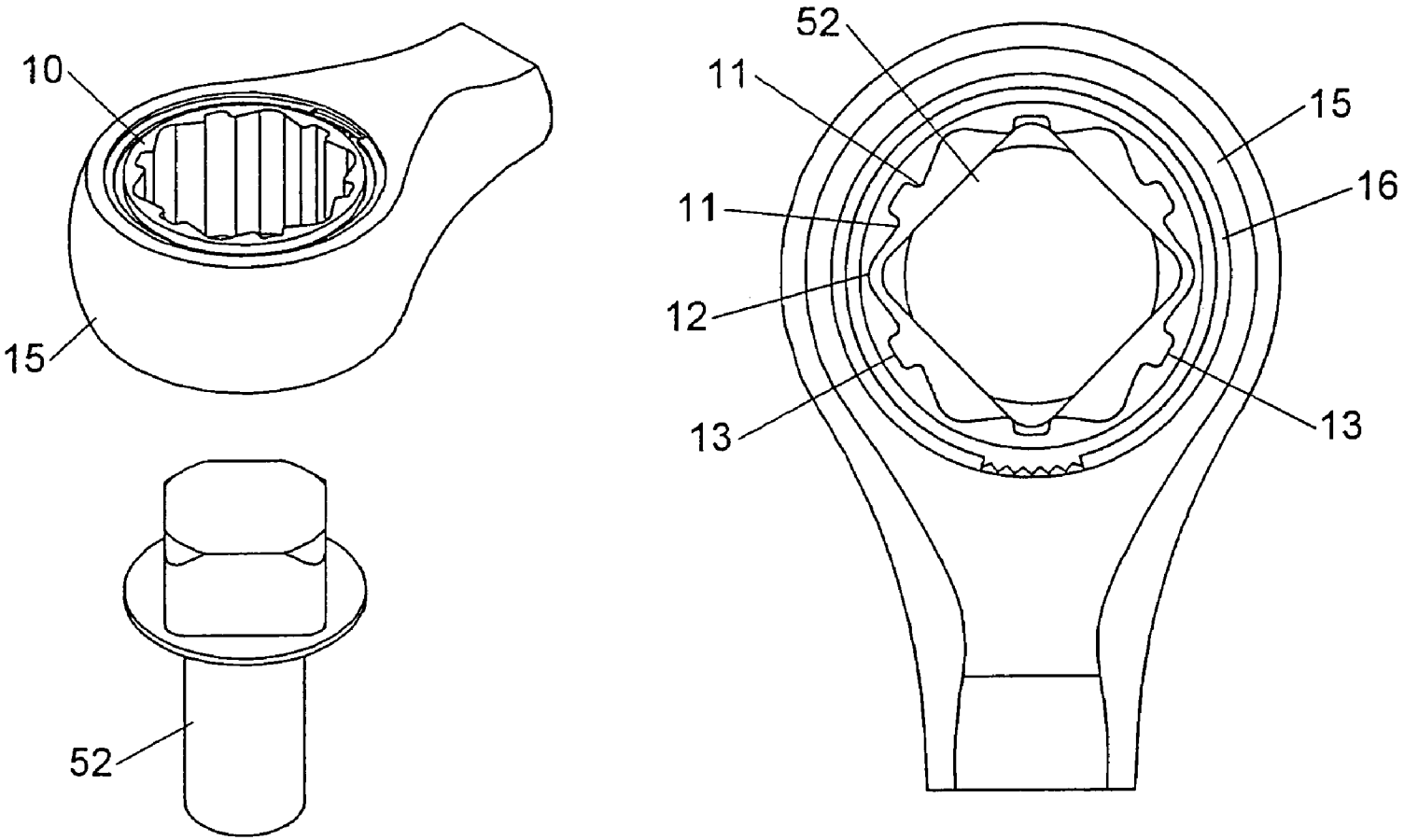
FIG. 10 is a schematic view of turning a tetragonal screw device according to the invention.

Referring to FIG. 10, the ratchet wheel 10 accommodates a tetragonal screw device 52, and the two grooves 13 of the ratchet wheel 10 can press against the two edges of the tetragonal screw device 52, such that the tetragonal screw device 52 can be turned.

Figure 11:
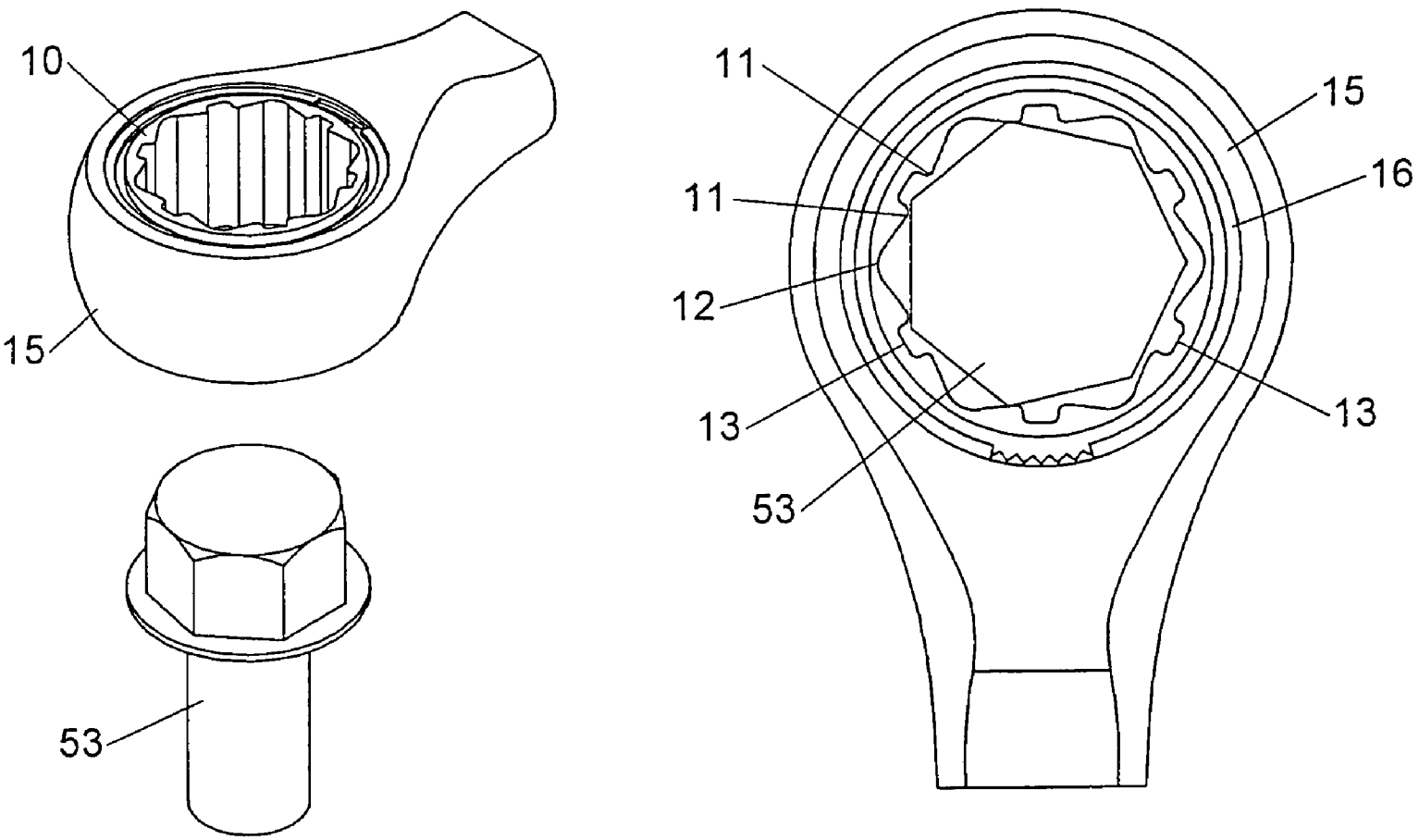
FIG. 11 is a schematic view of turning a heptagonal screw device according to the invention.

Referring to FIG. 11, the ratchet wheel 10 accommodates a heptagonal screw device 53, and a plurality of latch edges 11 of the ratchet wheel 10 cam press against a plurality of sides of the heptagonal screw device 53, such that the heptagonal screw device 53 can be turned.

Figure 12:
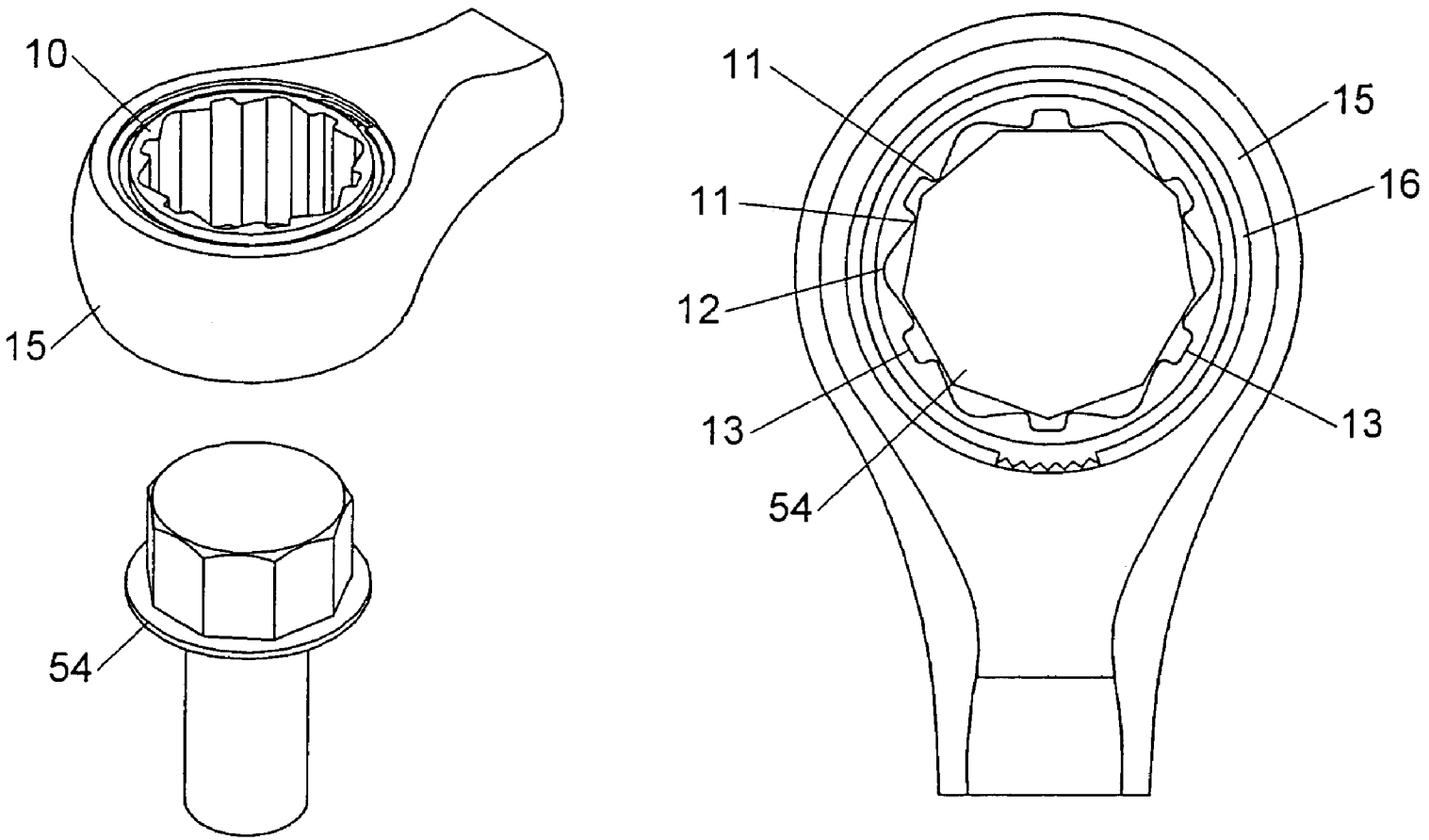
FIG. 12 is a schematic view of turning a enneagonal screw device according to the invention.

Referring to FIG. 12, the ratchet wheel 10 accommodates an enneagonal screw device, and a plurality of latch edges 11 and grooves 13 of the ratchet wheel 10 can press against all sides of the enneagonal screw device 54, such that the enneagonal screw device 54 can be turned.

Figure 13:
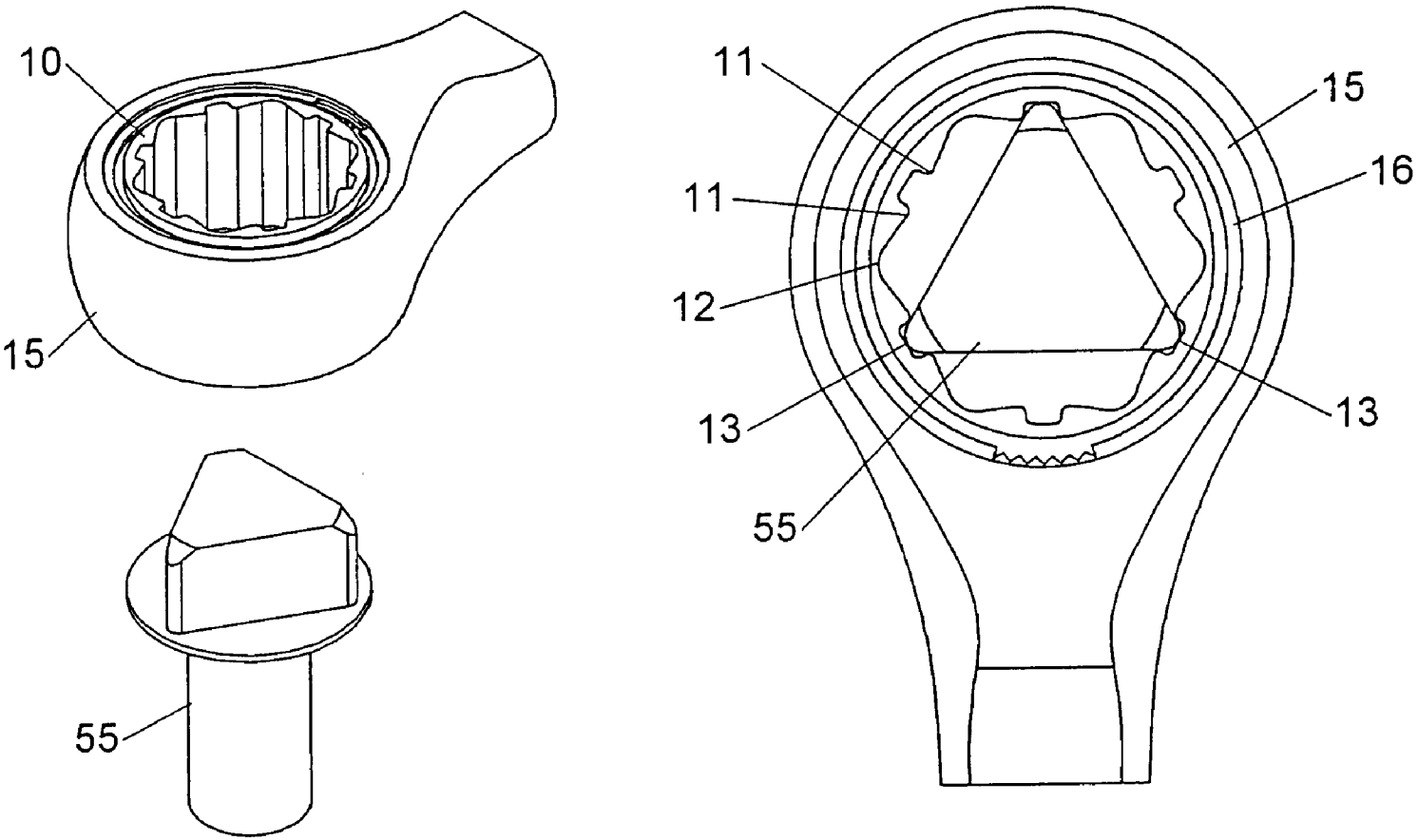
FIG. 13 is a schematic view of turning a triangular screw device according to the invention.

Referring to FIG. 13, the ratchet wheel 10 accommodates a triangular screw device 55, the three grooves 13 of the ratchet wheel 10 can press against the three corners of the triangular screw device 55, such that the triangular screw device 55 can be turned.

Figure 14:
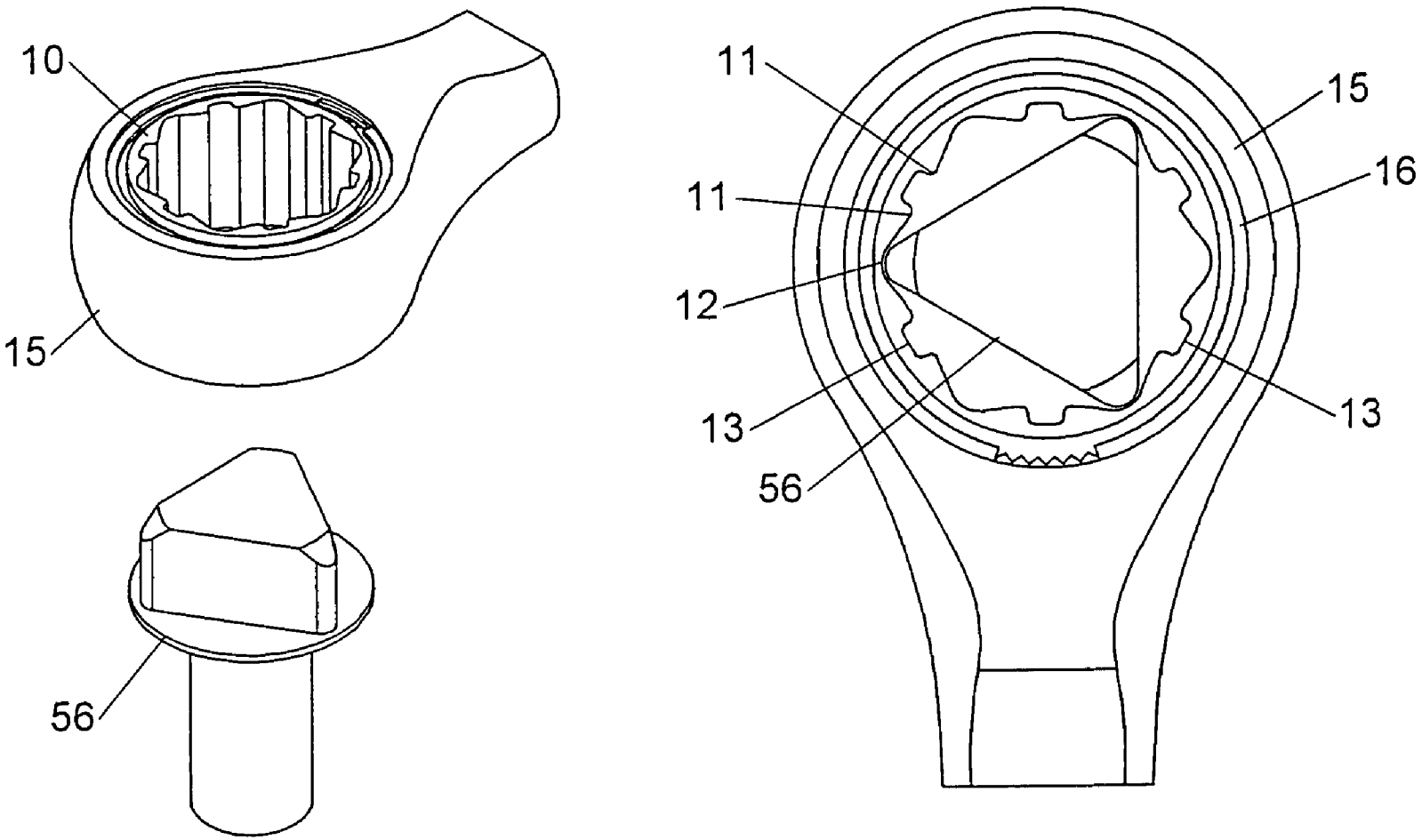
FIG. 14 is a schematic view of turning a triangular screw device according to the invention.

Referring to FIG. 14, the ratchet wheel 10 accommodates a large triangular screw device 56 and the three containing grooves 12 of the ratchet wheel 10 can press against the three corners of the large triangular screw device 56, such that the large triangular screw device 56 can be turned.

Figure 15:
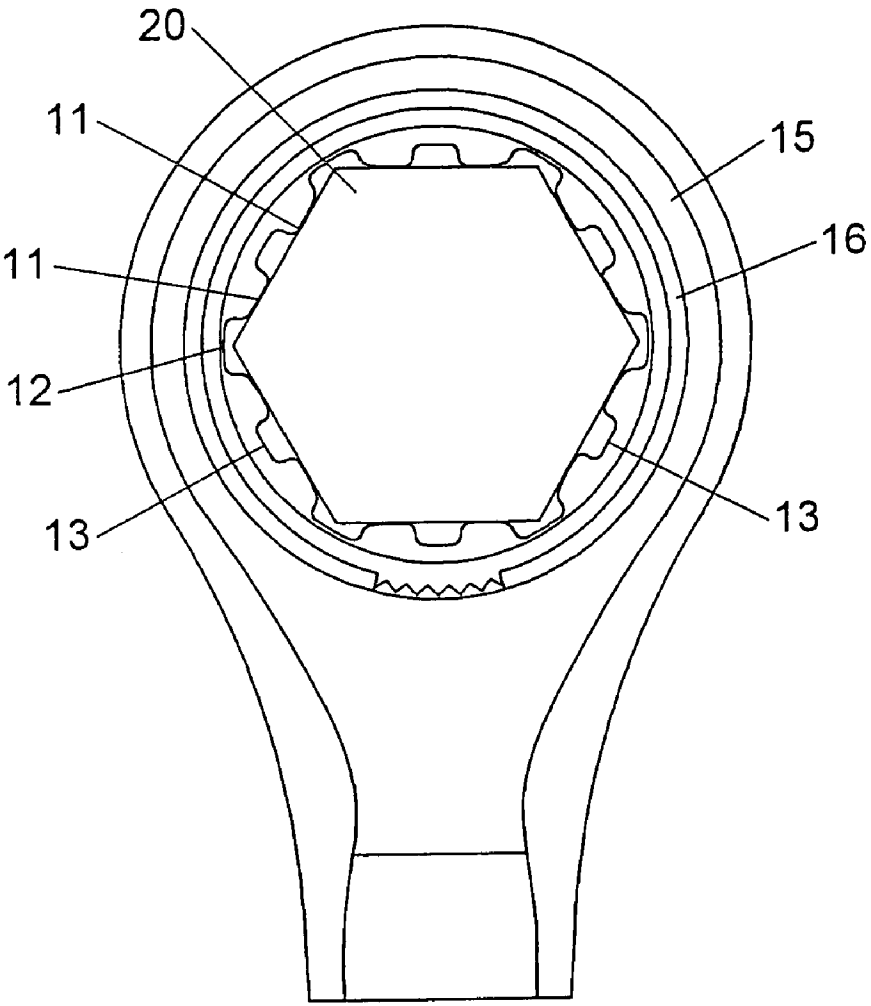
FIG. 15 is a schematic view of a second preferred embodiment of the invention.
Figure 15:
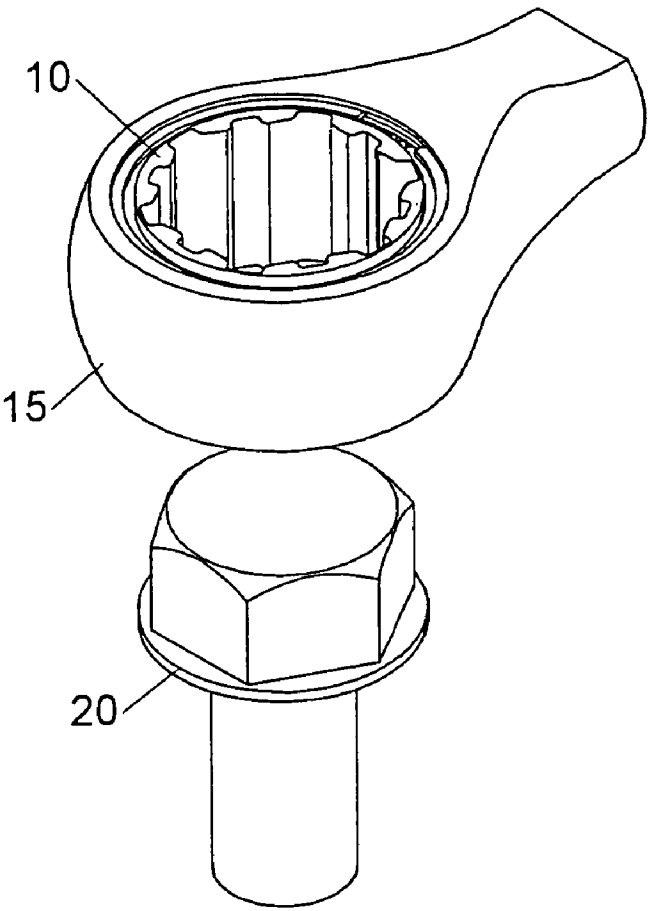

Referring to FIG. 15 for a second preferred embodiment, the latch edge 11 disposed at the internal circumference of the ratchet wheel 10 is a protruded curved surface, and this curved surface is comprised of two or more curved lines. The latch edge 11 of the ratchet wheel 10 includes a groove 13 disposed at the middle, such that the latch edge 11 is divided into two. The included angle between the two lateral sides of the groove 13 could be larger than or smaller than 90 degrees, and the bottom is in a curved form, so as to turn different screw devices with the same effect.

Figure 16:
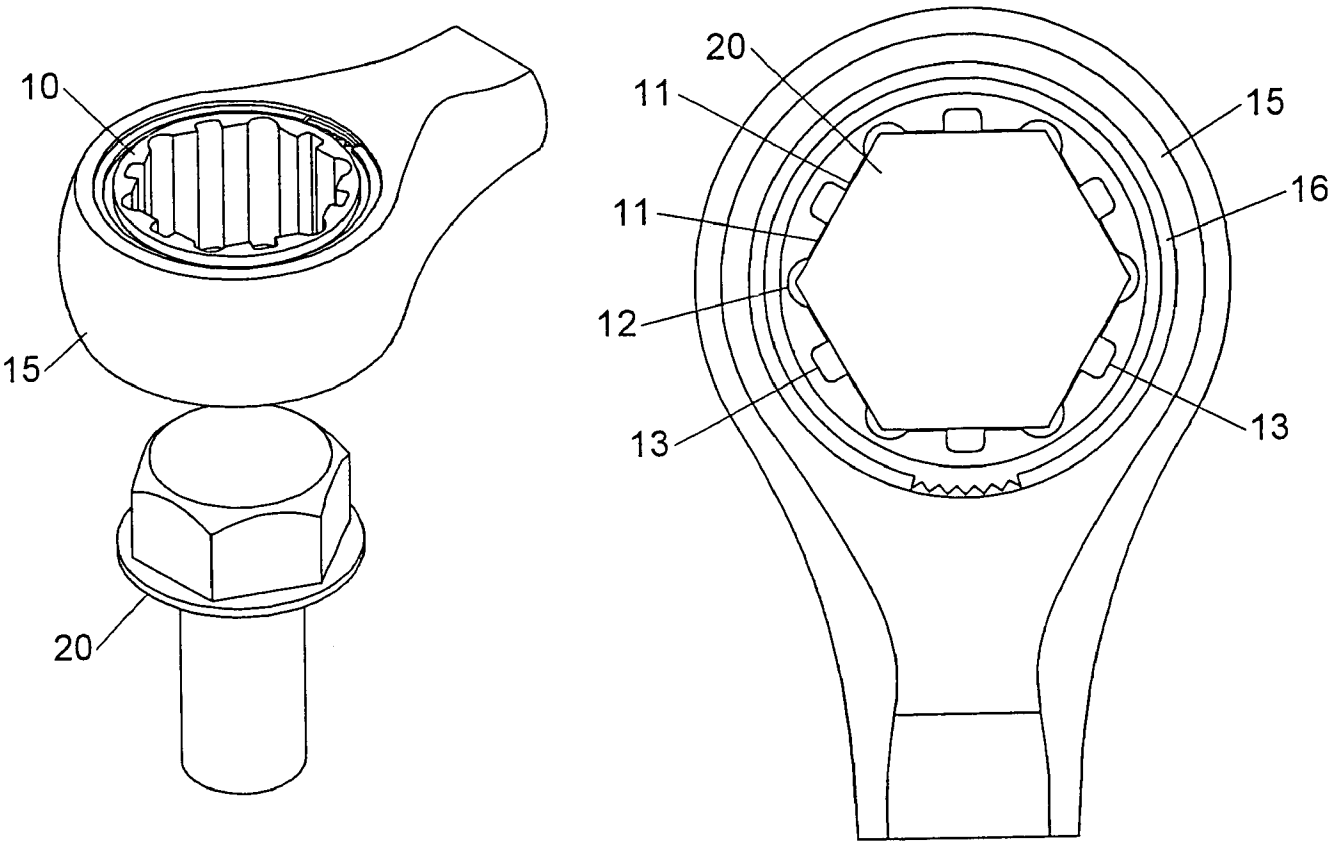
FIG. 16 is a schematic view of a third preferred embodiment of the invention.
Figure 17:
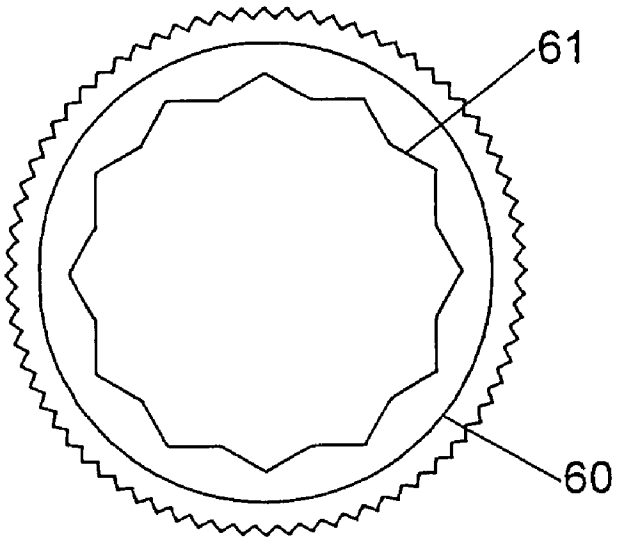
FIG.17 PRIOR ART
FIG. 17 is a perspective view of a prior art ratchet wheel structure.
Figure 17:
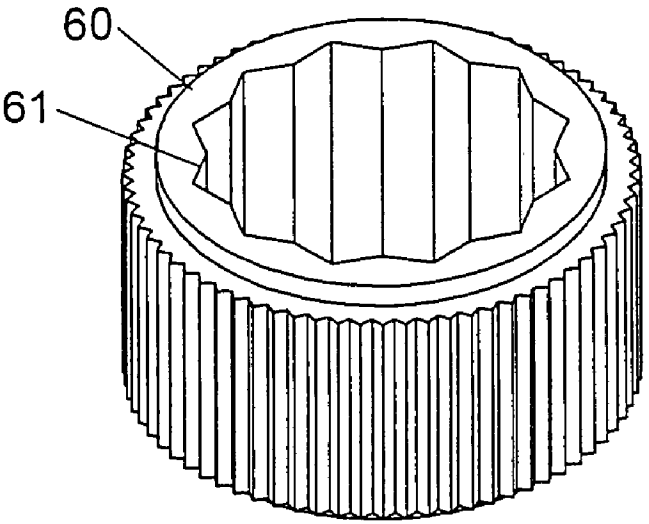
FIG.17 PRIOR ART

Referring to FIG. 16 for a third preferred embodiment, the latch edge 11 of the ratchet wheel 10 could be linear, and the six corners of the screw device 20 are accommodated into the containing grooves 12 of the ratchet wheel 10 and the latch edges 11 can be latched to the sides of the screw device 20.

The advantages of the present invention include:

1. The latch edge 11 of the ratchet wheel 10 in accordance with the invention is comprised of a curved line, a straight line or two or more curved lines to fit different shapes of the screw devices.
2. The invention maintains the original large radius of curvature and the small radius of curvature. A groove 13 is set on the large radius of curvature, so that the internal circumference of the ratchet wheel 10 includes the latch edge 11, the containing groove 12 and the groove 13 arranged in sequence to secure the hexagonal screw device 20.

What is claimed is:

1. A ratchet wheel structure, comprising a ratchet wheel, having a latch edge disposed at an internal periphery of said ratchet wheel, said ratchet wheel includes circular serrations around the periphery of said ratchet wheel, a containing groove and a groove arranged in sequence, and said latch edge is a flange, and said groove is protruded from the middle of a surface of said latch edge, said groove of said ratchet wheel is capable of containing a flange of a gear-shape screw device, and said groove of said ratchet wheel has two lateral sides parallel with each other, such that said latch edge is divided into two to achieve a better expandability.

2. The ratchet wheel structure of claim 1, wherein said latch edge at the internal circumferential surface of said ratchet wheel is a protruded curved surface.

3. The ratchet wheel structure of claim 1, wherein said groove of said ratchet wheel has the bottom of said groove is linear.

* * * * *